US006799497B1

(12) United States Patent
Creighton et al.

(10) Patent No.: US 6,799,497 B1
(45) Date of Patent: Oct. 5, 2004

(54) BI-DIRECTIONAL CUTTING OR TRIMMING KNIFE

(75) Inventors: James A. Creighton, 4500 Crestmore Dr., Des Moines, IA (US) 50310; Dwight A. Axtell, Ankeny, IA (US)

(73) Assignee: James A. Creighton, Des Moines, IA (US)

( * ) Notice: Subject to any disclaimer, the term of this patent is extended or adjusted under 35 U.S.C. 154(b) by 74 days.

(21) Appl. No.: 09/666,733

(22) Filed: Sep. 20, 2000

(51) Int. Cl.[7] ..... B26D 5/02; B26D 5/18

(52) U.S. Cl. ..... 83/643; 83/630; 83/694; 83/934

(58) Field of Search ..... 83/643, 647, 624, 83/625, 626, 630, 639.1, 644, 646, 694, 697, 776, 777, 783, 904, 933, 934, 638, 642

(56) References Cited

U.S. PATENT DOCUMENTS 227,356 A * 5/1880 Heckert ..... 83/643 X
508,329 A * 11/1893 Malm ..... 83/643 X
2,778,341 A * 1/1957 Papanoli et al. ..... 83/643 X
3,182,588 A * 5/1965 Bolliger ..... 83/646 X
3,523,476 A * 8/1970 Nakagawa ..... 83/643 X
3,555,953 A * 1/1971 Irwin ..... 83/647 X
3,714,856 A 2/1973 Hall et al. ..... 83/453
3,780,610 A 12/1973 Zadow ..... 83/643
3,830,121 A 8/1974 Makeev et al. ..... 83/81
3,857,316 A * 12/1974 Handley ..... 83/644
3,866,503 A * 2/1975 Gal ..... 83/630 X
3,945,287 A * 3/1976 Dvorak ..... 83/643 X
3,948,134 A * 4/1976 Mori ..... 83/643 X
4,122,740 A * 10/1978 Maltby ..... 83/646
4,836,074 A 6/1989 Mohr ..... 83/379
4,850,257 A 7/1989 Mohr ..... 83/93
5,150,641 A * 9/1992 Werner ..... 83/647

* cited by examiner

*Primary Examiner*—Clark F. Dexter
(74) *Attorney, Agent, or Firm*—McKee, Voorhees & Sease, P.L.C.

(57) ABSTRACT

A cutting or trimming knife for cutting or trimming the edges of sheet members is bi-directional and capable of moving downwardly and in a first lateral direction, or alternatively downwardly and in a second opposite lateral direction. The knife is held by a guide mechanism capable of shifting between first and second positions to cause the bi-directional movement of the knife.

13 Claims, 5 Drawing Sheets

BI-DIRECTIONAL CUTTING OR TRIMMING KNIFE

BACKGROUND OF THE INVENTION

The present invention relates to a bi-directional cutting or trimming knife and method for using same.

Trimming knives have been used to trim the edges of a stack of sheet members. An example of such a use is the trimming in a bindery of the edges of bound books. Trimming knives for accomplishing this function generally move in a downward direction and in a lateral direction with respect to the sheet members being trimmed. However, prior art trimming knives generally are capable of moving only in a single lateral direction during the trimming process.

Cutting knives have been used to cut the edges of a stack of unbound sheet members. Cutting knives, like trimming knives, have generally been capable of moving only in a single lateral direction.

Therefore a primary object of the present invention is the provision of a bi-directional cutting or trimming knife and method for using same.

A further object of the present invention is the provision of a cutting or trimming knife which can be moved in a first lateral direction or in a second lateral direction during the downward movement of the knife towards the sheet members being trimmed.

A further object of the present invention is the provision of a cutting or trimming knife which is bi-directional, but which is rigidly held in proper alignment during its trimming action.

A further object of the present invention is the provision of a cutting or trimming knife which can be easily and rapidly transferred from a first position to be movable in one lateral direction during one trimming or cutting cut, to a second position movable in another lateral direction during another trimming or cutting cut.

A further object of the present invention is the provision of a cutting or trimming knife which can be easily and rapidly transferred from a first position to be movable in one lateral direction during one trimming or cutting motion, to a second position movable in another lateral direction during another trimming or cutting motion.

A further object of the present invention is the provision of a cutting or trimming knife that will not dull as quickly due to full use of the length of the knife edge.

A further object of the present invention is the provision of a bi-directional cutting or trimming knife which is economical to manufacture, durable in use, and efficient in operation.

SUMMARY OF THE INVENTION

The foregoing objects may be achieved by an apparatus for trimming or cutting a stack of sheet members having edges to be trimmed and being supported on a cutting table. The apparatus includes an elongated knife having a cutting edge extending along the cutting axis of the knife. A knife supporting frame is connected to the cutting table and a guide mechanism mounts the knife to the supporting frame for movement of the knife from a start position wherein the knife is positioned spaced from the cutting table and the sheet members to a cut position wherein the knife moves towards the cutting table and cuts or trims the stack of sheet members. At least a portion of the guide mechanism is movable on the frame to a first guide position causing the knife to move in a first direction relative to the cutting edge axis when moving from its starting position to its cut position. At least a portion of the guide mechanism is movable on the frame to a second guide position causing the knife to move in a second direction opposite from the first direction when moving from its start position to its cut position.

The guide mechanism may include a linkage which pivots during movement of the knife between its start and cut positions. However other guide mechanisms can also be used such as slots in plates for guiding the knife. Other mechanisms also may be used for guiding the knife bi-directionally.

The method for using the knife includes cutting or trimming the first edge of the stack of sheet members by moving the cutting edge of the knife in a downwardly inclined direction extending both toward the first edge of the stack and in a first lateral direction along the knife axis until the cutting edge engages and trims the first edge of the stack of sheet members. The knife is then lifted upwardly away from the stack of sheet members. A second trimming step includes trimming the second edge of the stack by moving the cutting edge of the knife in a downwardly inclined direction extending both toward the second edge of the stack and in a second lateral direction opposite from the first lateral direction until the cutting edge engages and trims the second edge of the stack of sheet members.

DETAILED DESCRIPTION OF THE PREFERRED EMBODIMENT

Figure 1:
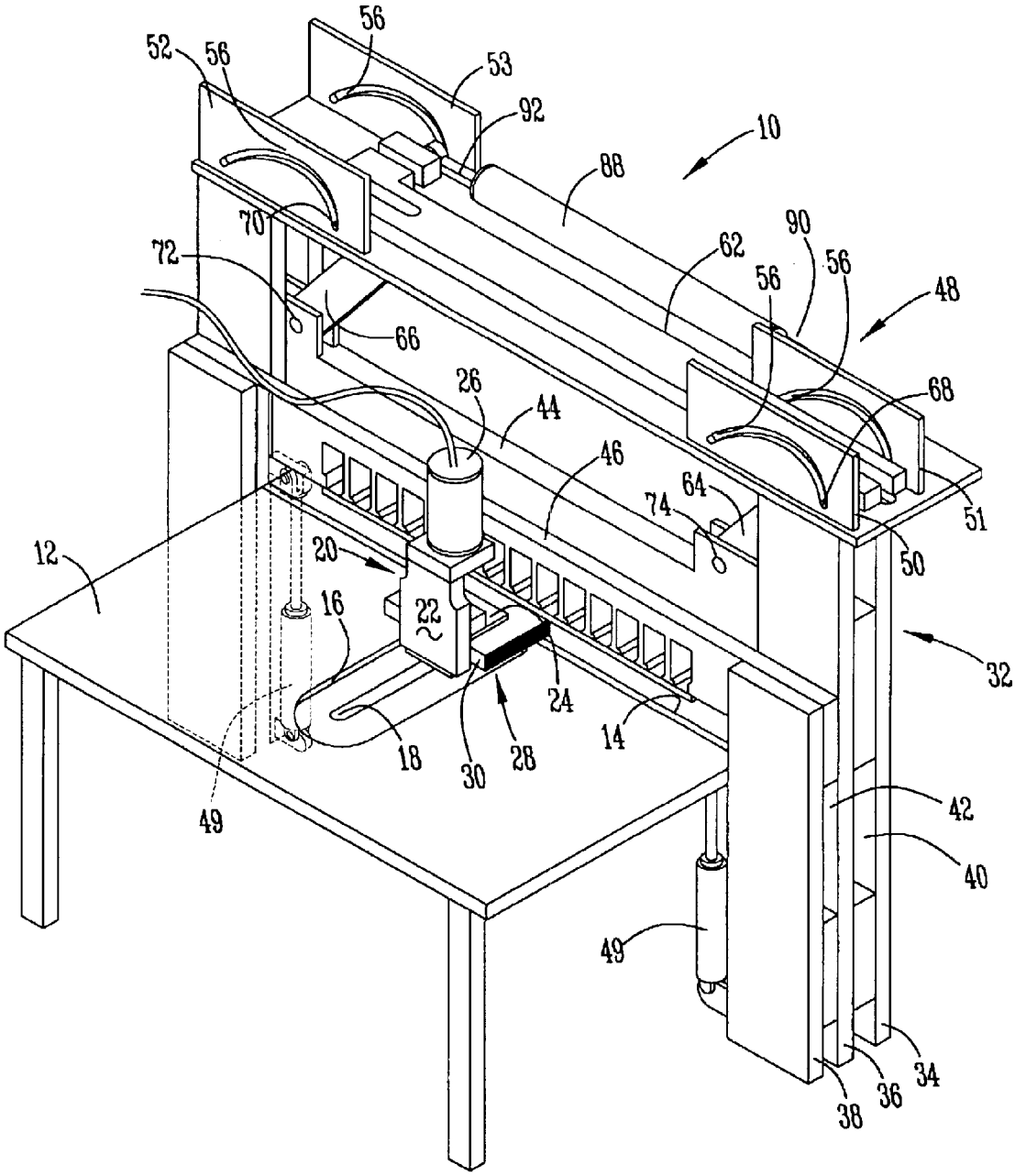
FIG. 1 is a perspective view of the apparatus for trimming the sheet members.

Referring to the drawings the numeral 10 generally designates the trimming machine of the present invention. While machine 10 shows the preferred embodiment, variations in the various components of the machine may be made without detracting from the invention.

Machine 10 includes a cutting table 12 having a back edge 14 and having a table recess 16 formed in its upper surface. Table slot 18 is contained within the table recess 16 and receives a book holder 20. Book holder 20 includes a holder frame 22 which supports a book holder plate 24 on the end of a rod extending from pneumatic cylinder 26. A book 28 is shown being held by the holder plate 24. Book 28 includes a spine 30. The book holder 20 is capable of holding the book 24 and moving within slot 18 to present the various edges of the book 24 adjacent the back edge 14 of the cutting table. Device 20 is also capable of rotating about a vertical axis to present various edges of the book to the back edge 14 of the cutting table.

Extending upwardly above table 12 is a support frame 32 which is comprised of a first vertical frame member 34, a second vertical frame member 36, and a third vertical frame member 38. Members 34, 36, 38 are spaced apart so as to create a knife guide space 40 and a clamp guide space 42 therebetween. Knife guide space 40 and clamp guide space 42 are shown to be formed as spaces between spaced apart plates, but they also could be vertical grooves on the opposing inner faces of vertical legs.

Within the knife guide space 40 is a knife holder 44 which is capable of vertical sliding movement within the knife guide space 40. Within the clamp guide space 42 is a cutting clamp 46 which is capable of sliding vertically upwardly and downwardly. A pair of clamp cylinders 49 are connected to the cutting clamp 46 for moving it from an elevated position to a lowered position. In the lowered position shown in FIG. 1, the cutting clamp 46 clamps the book 28 against the upper surface of the table 12 and holds it in place for the trimming operation.

An elongated cross frame member 48 is mounted at the upper ends of the first and second vertical frame members 34, 36. Attached to the cross frame member 48 are a first guide plate 50, a second guide plate 51, a third guide plate 52, and a fourth guide plate 53. Each of the guide plates 50, 51, 52, 53 include an arcuate slot 56 therein. The cross member 48 includes a pair of elongated floor slots 58, 60 shown in FIGS. 2 and 3.

Figure 2:
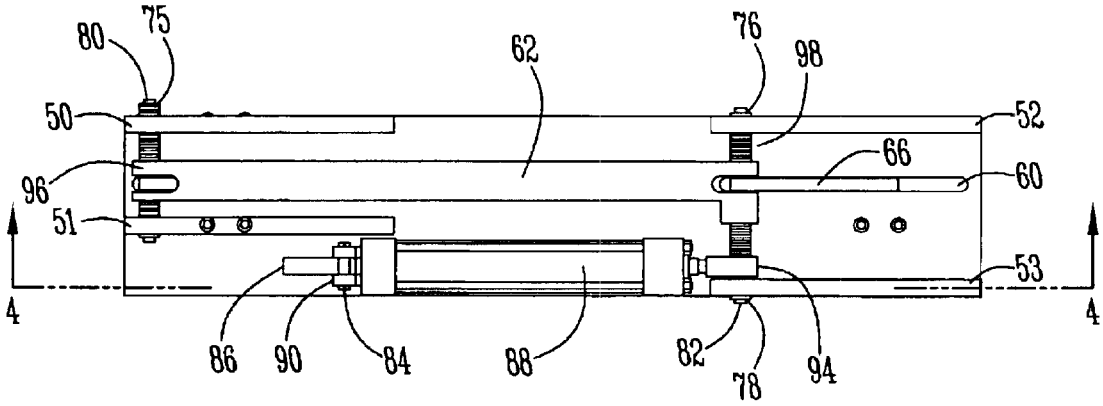
FIG. 2 is a top plan view of the linkage mechanism for controlling the movement of the knife.
Figure 3:
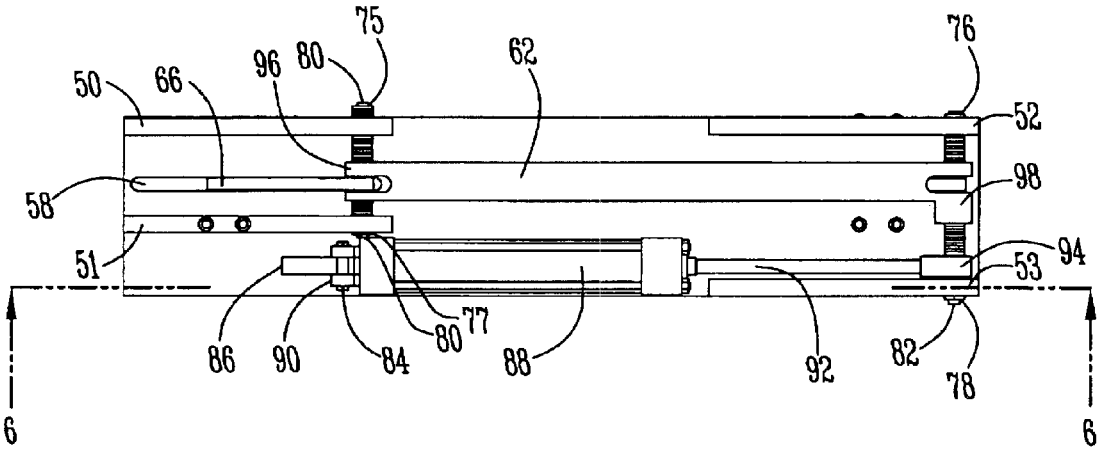
FIG. 3 is a view similar to FIG. 2, but showing the linkage mechanism in a second position.

A linkage mechanism for supporting and controlling the movement of the knife 44 is comprised of a horizontal base link or transfer arm 62, a side link 64, and a second side link 66. As can best be seen in FIGS. 4 and 6, the two side links 64, 66 are pivoted at their upper ends to the opposite ends of horizontal base link or transfer arm 62 for pivotal movement about pivot points 68, 70. The lower ends of the side links 64, 66 are pivoted to the opposite ends of the knife holder 44 for pivotal movement about pivotal axes 72, 74. First, second, third and fourth guide followers or bearings 75, 76, 77, 78 (FIGS. 2 and 3) are positioned within the slots 56 of the guide plates 50, 51, 52, 53 respectively. These guide followers 75, 76, 77, 78 are mounted for rotational movement on a first pin 80, and a second pin 82 as can be seen in FIGS. 2 and 3.

A pneumatic cylinder 88 is mounted to the cross frame member 48 by means of a cylinder pin 84 extending through a hole in a cylinder mount 86 and a cylinder clevis 90. Extending from the cylinder 88 is a cylinder rod 92 (FIG. 3) having a rod clevis 94 on the end thereof. The rod clevis 94 includes the pin 82 extending there through. The base link or transfer arm 62 includes a first base link clevis 96 which is mounted upon pin 80 and includes a second base link clevis 98 which is mounted upon second pin 82.

Attached to the knife holder 44 is a knife 100 (FIGS. 4–7) having a downwardly presented knife edge 102. A knife cylinder 104 includes a cylinder clevis 106 which connects the lower end of knife cylinder 104 to the vertical frame member 34, and includes a cylinder rod 108 having a rod clevis 110 pivotally connected to the knife holder 44.

Figure 4:
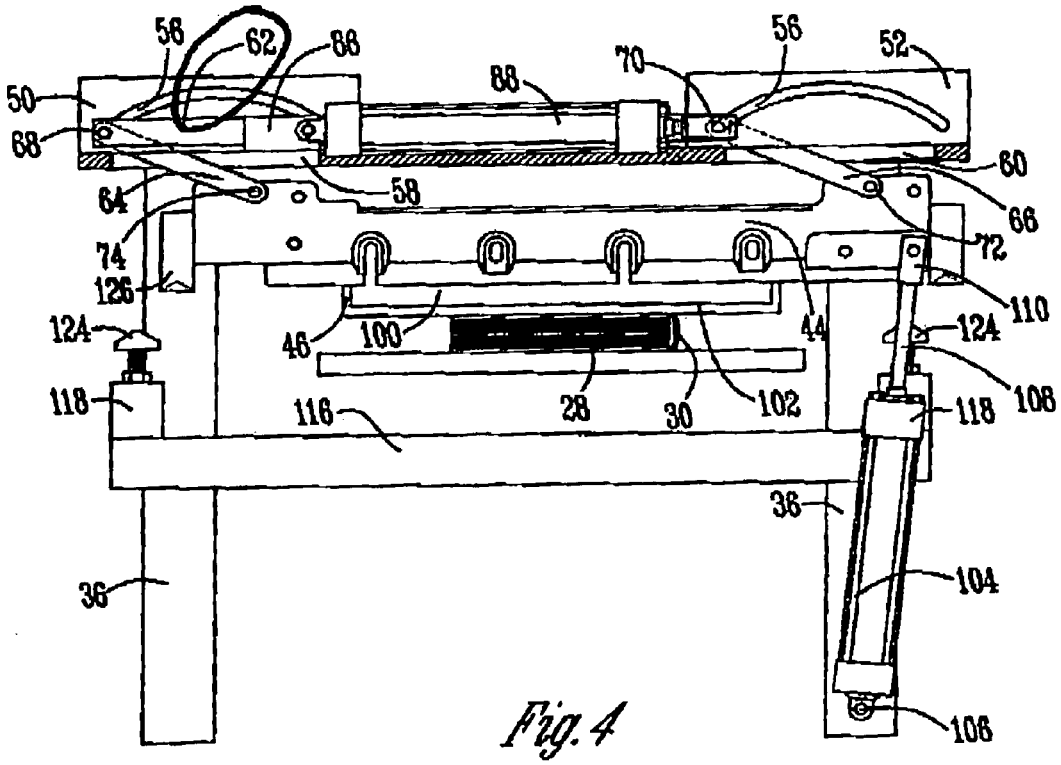
FIG. 4 is a sectional view taken along line 4—4 of FIG. 2, showing the knife in an elevated position and showing the linkage mechanism in a first position corresponding to that shown in FIG. 2.
Figure 5:
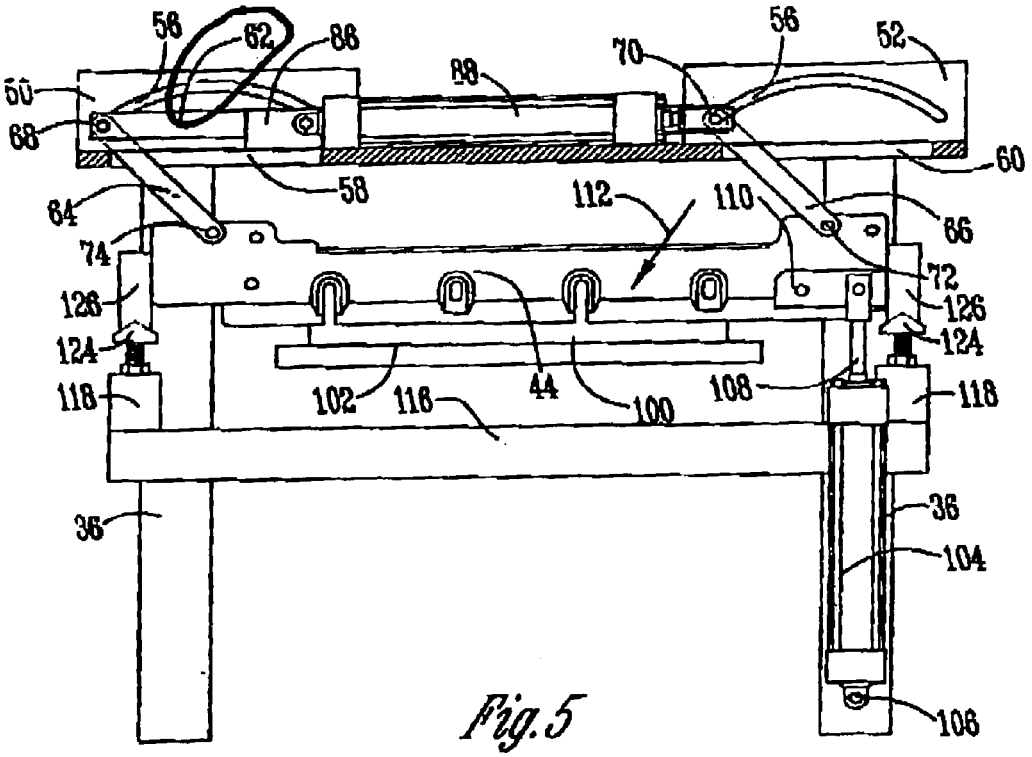
FIG. 5 is a view similar to FIG. 4 but showing the knife in its lowered position.

The rod 108 of the knife cylinder 104 is extensible and retractable to move the knife holder from a raised position to a lowered position. FIGS. 4 and 5 show one of the two bi-directional lateral movements that can be achieved with the present invention. In FIG. 4 the cylinder 88 is positioned in its retracted position. This causes base link or transfer arm 62 to move to its left position with the pivot points 68, 70 being in the left ends of the arcuate slots 56. In this position the side links 64, 66 angle downwardly and to the right from the opposite ends of base link 62. Retraction of knife cylinder 104 causes the knife holder 44 to be pulled downwardly and to the left in the direction of the arrow 112 shown in FIG. 5. This causes the knife edge 102 to engage the book 28 and to trim the edge of the sheet members within the book 28. The spine 30 of the book 28 is positioned so that the knife while moving in the direction of arrow 112 moves downwardly and to the left which for purposes of reference will be referred to as "into" the spine 30. This is important because if the knife moves straight down or to the right which for purposes of reference will be referred to as "away from" the spine it will damage the spine of the book.

Figure 8:
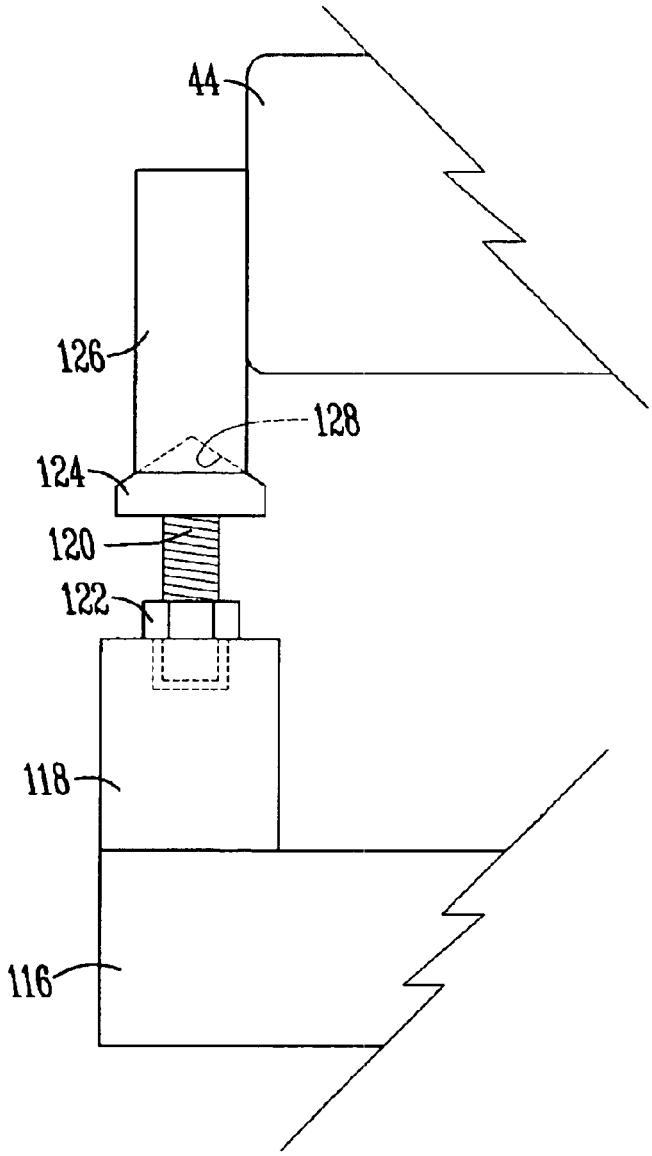
FIG. 8 is an enlarged detail view of the locator assembly of the present invention.

Attached to the vertical frame members 36 and extending horizontally therebetween is a horizontal locator frame member 116 having a pair of fixed locator blocks 118 attached to its opposite ends. As shown in FIG. 8 locator bolt 120 is threaded within a block 118. A nut 122 is provided as a lock nut. On the upper end of locator bolt 120 is a cone shaped fixed locator 124.

Attached to the knife holder 44 is a knife locator block 126. The downwardly presented surface of locator block 126 includes a cone shaped receptacle 128 shaped to matingly receive the cone shaped locator 124.

Figure 7:
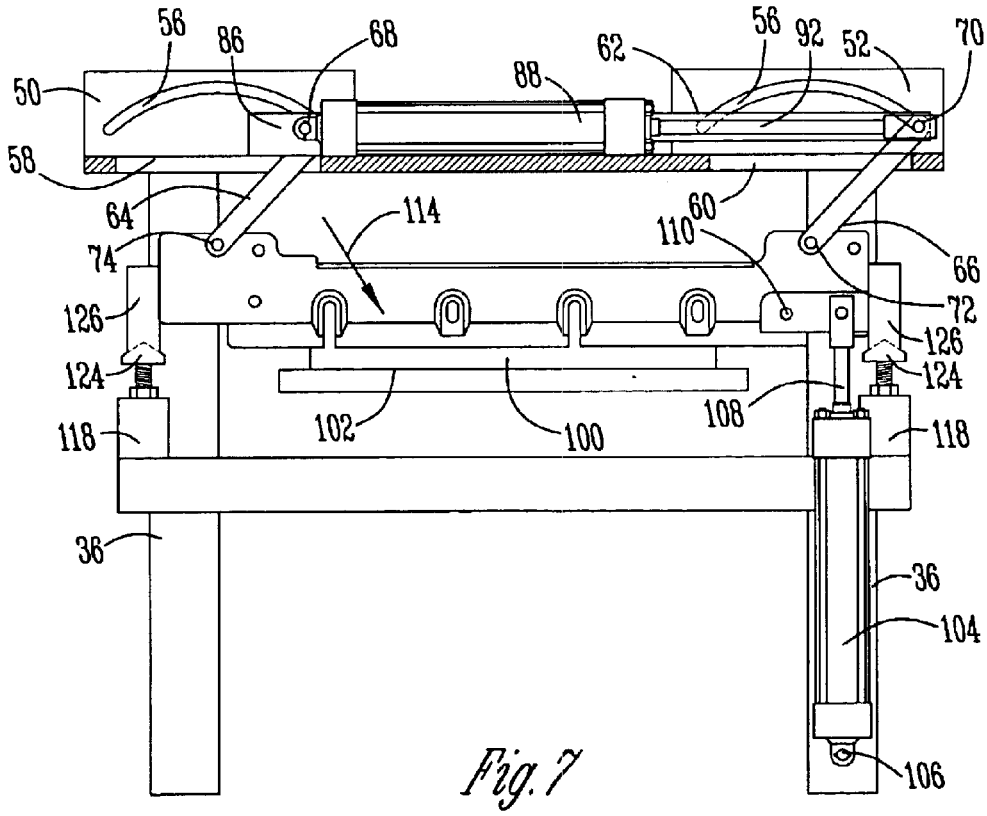
FIG. 7 is a view similar to FIG. 6, but showing the knife in its lowered position.

When the knife 100 is moved to its lower position shown in FIGS. 5 and 7 the cone shaped locator 124 mates inside the cone shaped receptacle 128. The cylinder 104 remains activated to hold the two locators 124 firmly within the two receptacles 128. This maintains the knife in a precise orientation which is preferably horizontal, but which could be angular if desired. The precise orientation can be adjusted by rotating bolts 120 within block 118. The cone shaped locators 124 and the cone shaped receptacles 128 cooperate to prevent misalignment of the knife holder 44 in any direction during the transfer action.

Figure 6:
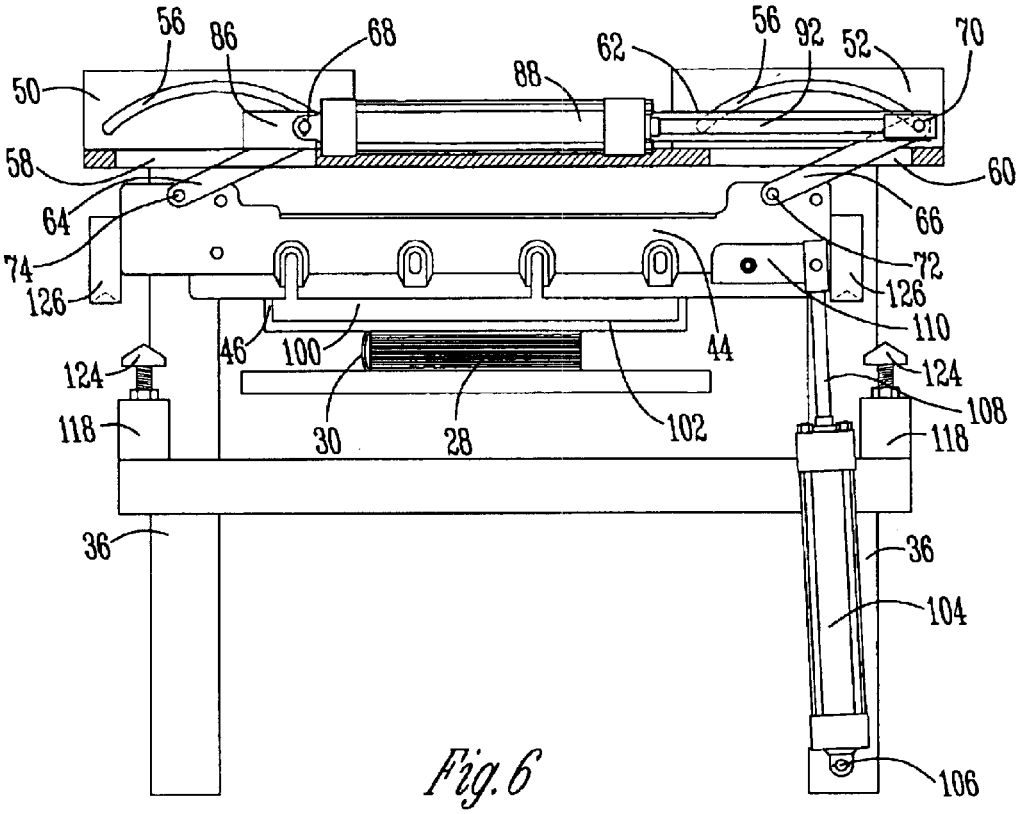
FIG. 6 is a sectional view taken along line 6—6 of FIG. 3, showing the knife in an elevated position, and showing the linkage mechanism in its second position corresponding to FIG. 3.

The extension and retraction of cylinder 88 is always done with the knife in its lower position (FIGS. 5 and 7) seated on the cones 124. FIGS. 6 and 7 show the linkage mechanism in its second position. In this position the cylinder 88 is extended and this causes the base link or transfer arm 62 to move to the right so that the pivot points 68, 70 are located in the right-hand ends of the arcuate slots 56. In this position the links 64, 66 extend downwardly and to the left from the opposite ends of base link 62. A comparison of FIGS. 4 and 6 show that the angular direction of the links 64, 66 have been reversed from the position in FIG. 4 to the position in FIG. 6.

It should also be noted that the book 28 has been rotated so that the spine 30 is on the left edge of the book rather than on the right edge of the book. As the knife cylinder 104 is moved to its retracted position it causes the knife holder 44 to move downwardly and to the right in the direction of arrow 114 to engage the book 28 and trim the edges of the sheet members in that book. As can be seen in FIGS. 6 and 7 this movement of the knife is downwardly and to the right into the spine 30 of the book.

The apparatus of the present invention provides a bi-directional knife which can be moved from a first position wherein the knife moves downwardly and to the left in the direction of arrow 112 (FIG. 5) to a second position shown in FIG. 6 where the knife moves downwardly and to the right in the direction of arrow 114 (FIG. 7). This enables the trimming apparatus to use a single knife for cutting the various edges of the book whereas prior art devices required two or more knives to cut the edges so as to insure that the cutting movement is always into the spine 30.

One advantage of a bi-directional knife is that it will have a prolonged wear life over that obtained by prior art single directional knives. The book or other stack of sheet members usually is about one-half the length of the knife. A single directional knife will always use the same half of the blade to cut the sheet members. But the bi-directional knife of the present invention can be configured to use two separate and distinct portions of the knife edge for its two bi-directional modes, thereby doubling the wear life of the blade.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. Apparatus for cutting or trimming a stack of sheet members comprising:

a cutting table;

an elongated knife having a cutting edge extending along an elongated cutting edge axis;

a knife supporting frame connected to said cutting table;

a guide mechanism mounting said knife to said supporting frame for movement of said knife from one of a plurality of start positions wherein said knife is positioned spaced from said cutting table and said stack of sheet members to a cut position wherein said knife is positioned proximate said cutting table, wherein said knife moves towards said cutting table and trims or cuts said stack of sheet members;

at least a portion of said guide mechanism being movable on said frame to a first guide position causing said knife to be positioned in a first start position and to move in a first direction relative to said cutting edge axis when moving from said first start position to said cut position;

at least a portion of said guide mechanism being movable on said frame to a second guide position causing said knife to be positioned in a second start position and to move in a second direction opposite from said first direction when moving from said second start position to said cut position;

said guide mechanism comprising a linkage mechanism, wherein said linkage mechanism includes an elongated base link, a first link pivotally connected to said base link and said knife, and a second link pivotally connected to said base link and said knife; and a linkage power means connected to said linkage mechanism for moving said linkage mechanism between said between said first and second guide positions, said linkage power means being connected to said base link and said support frame.

2. Apparatus according to claim 1 wherein said linkage power means comprises an extensible fluid cylinder.

3. Apparatus according to claim 1 wherein said base link, said first and second links, and said knife combine to form a parallelogram.

4. Apparatus according to claim 3 wherein said guide mechanism further comprises at least one guide track attached to said frame, said linkage mechanism having a track follower guided within said guide track for guided movement therein during movement of said linkage mechanism between said first and second guide positions.

5. Apparatus for trimming or cutting a stack of sheet members comprising:

a cutting table;

a support frame connected to said cutting table and extending upwardly therefrom;

a linkage mechanism comprising a base link and first and second side links pivotally connected to said base link and extending downwardly therefrom;

an elongated knife holder having an elongated knife with a cutting edge mounted thereto, and being pivotally connected to said first and second side links, whereby said base link, said first and second side links, and said knife holder form a collapsible parallelogram;

an extensible cylinder connected to said frame and to said knife holder for moving said knife from one of a plurality of start positions spaced from said table to a cut position proximate said table;

said base link being movably mounted to said support frame for movement from a first link position wherein said first and second links angle downwardly at an inclined first angle when said knife is in a first start position to a second link position wherein said first and second side links angle downwardly at an inclined second angle opposite from said first angle when said knife is in a second start position.

6. Apparatus for cutting or trimming a stack of sheet members comprising:

a cutting table;

an elongated knife having a substantially straight cutting edge extending along an elongated cutting edge axis;

a knife supporting frame connected to said cutting table;

a guide mechanism mounting said knife to said supporting frame for movement of said knife from one of a plurality of start positions wherein said knife is positioned spaced from said cutting table and said stack of sheet members to a cut position wherein said knife is positioned proximate said cutting table, wherein said knife moves toward said cutting table and trims or cuts said stack of sheet members;

at least a portion of said mechanism guide being movable on said frame to a first guide position of the guide mechanism for causing said knife to be positioned in a first start position and to move in a first direction relative to said cutting edge axis when moving from said first start position to said cut position; and at least a portion of said guide mechanism being movable on said frame to a second guide position of the guide mechanism for causing said knife to be positioned in a second guide position and to move in a second direction opposite from said first direction when moving from said start position to said cut position.

7. Apparatus according to claim 6 wherein said guide mechanism comprises a linkage mechanism.

8. Apparatus according to claim 7 wherein said linkage mechanism includes an elongated base link, a first link pivotally connected to said base link and said knife, and a second link pivotally connected to said base link and said knife.

9. Apparatus according to claim 8 and further comprising a linkage power means connected to said linkage mechanism for moving said linkage mechanism between said first and second guide positions.

10. Apparatus according to claim 9 wherein said linkage power means comprises an extensible fluid cylinder.

11. Apparatus according to claim 9 wherein said linkage power means is connected to said base link and said support frame.

12. Apparatus according to claim 9 wherein said base link, said first and second links, and said knife combine to form a parallelogram.

13. Apparatus according to claim 12 wherein said guide mechanism further comprises at least one guide track attached to said frame, said linkage mechanism further having a track follower guided within said guide track for guided movement therein during movement of said linkage mechanism between said first and second guide positions.

* * * * *